United States Patent [19]

Siegel et al.

[11] 4,177,622

[45] Dec. 11, 1979

[54] BAG SEALING APPARATUS WITH BAG EVACUATION MEANS

[75] Inventors: Martin Siegel, Englewood Cliffs; Eugene Millevoi, Fort Lee; Boleslaw L. Budzyn, Passaic, all of N.J.

[73] Assignee: Weldotron Corporation, Piscataway, N.J.

[21] Appl. No.: 913,522

[22] Filed: Jun. 7, 1978

[51] Int. Cl.[2] ..... B65B 31/04

[52] U.S. Cl. ..... 53/511

[58] Field of Search ..... 53/511, 512

[56] References Cited

U.S. PATENT DOCUMENTS

| | | | |
|---|---|---|---|
| 2,753,671 | 7/1956 | DePuy et al. | 53/511 |
| 3,164,934 | 1/1965 | Pancratz | 53/511 |
| 3,193,982 | 7/1965 | Herzmark et al. | 53/512 |
| 3,376,690 | 4/1968 | Jianas | 53/512 |

*Primary Examiner*—Travis S. McGehee

*Attorney, Agent, or Firm*—Robert A. Green

[57] ABSTRACT

The apparatus includes an L-sealer and a supply of folded film which is fed across a horizontal table to the vicinity of the sealer, where a product to be packaged is placed between the upper and lower sheets of folded film. The sealer is then operated to hold closed the open side of the film opposite the fold and thus to form a bag which is closed, but not sealed, on three sides.

The edge of the table facing the open end of the bag is provided with a vacuum chamber which is operated to remove air from the bag, whereupon the L-sealer is operated to complete the sealing of the bag and the severing of the bag from the film supply.

11 Claims, 10 Drawing Figures

Fig. 1
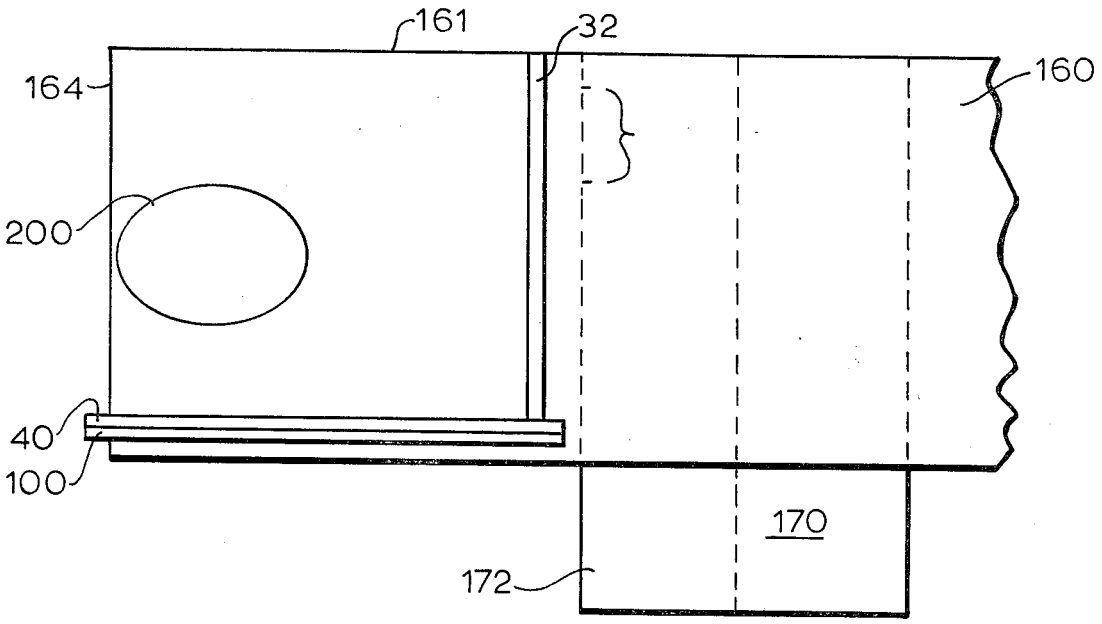
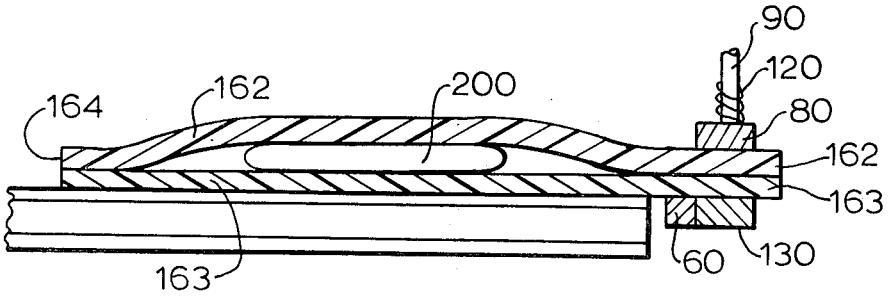
Fig. 3

BAG SEALING APPARATUS WITH BAG EVACUATION MEANS

BACKGROUND OF THE INVENTION

The use of centerfolded film in conjunction with L-shaped sealing machines in either a horizontal or vertical configuration is a very common packaging technique today. Furthermore, the bulk of the film used in this method is shrink film, which shrinks to conform closely to the product when exposed to a proper source of heat (generally hot air jets). It is a characteristic of this packaging method that the air entrapped as the film shrinks will cause a "ballooning" effect and prevent the film from conforming to the product unless a bleeder hole is punched in the film to permit the entrapped air to escape. While this technique is acceptable for many products, there are many categories of products, such as perishable food items, where the use of a bleeder hole is not acceptable because it can permit dust contamination, or, in the case of certain meat products intended to be freezer-stored, it increases the likelihood of "freezer-burn."

There are other categories of perishable food products which are currently packaged in evacuated bags wherein considerable economies could be realized if it were possible to package these products directly on L-sealer equipment utilizing different types of new structured, co-extruded films in centerfolded configurations. The new air-evacuated system described below satisfies this requirement.

DESCRIPTION OF THE DRAWINGS

FIG. 1 is a plan view, schematic representation of some of the principal features of the apparatus of the invention;

FIG. 3 is a sectional view, along the lines 3—3 in FIG. 2, showing the apparatus of the invention in one stage of its operation;

DESCRIPTION OF THE PREFERRED EMBODIMENTS

Figure 2:
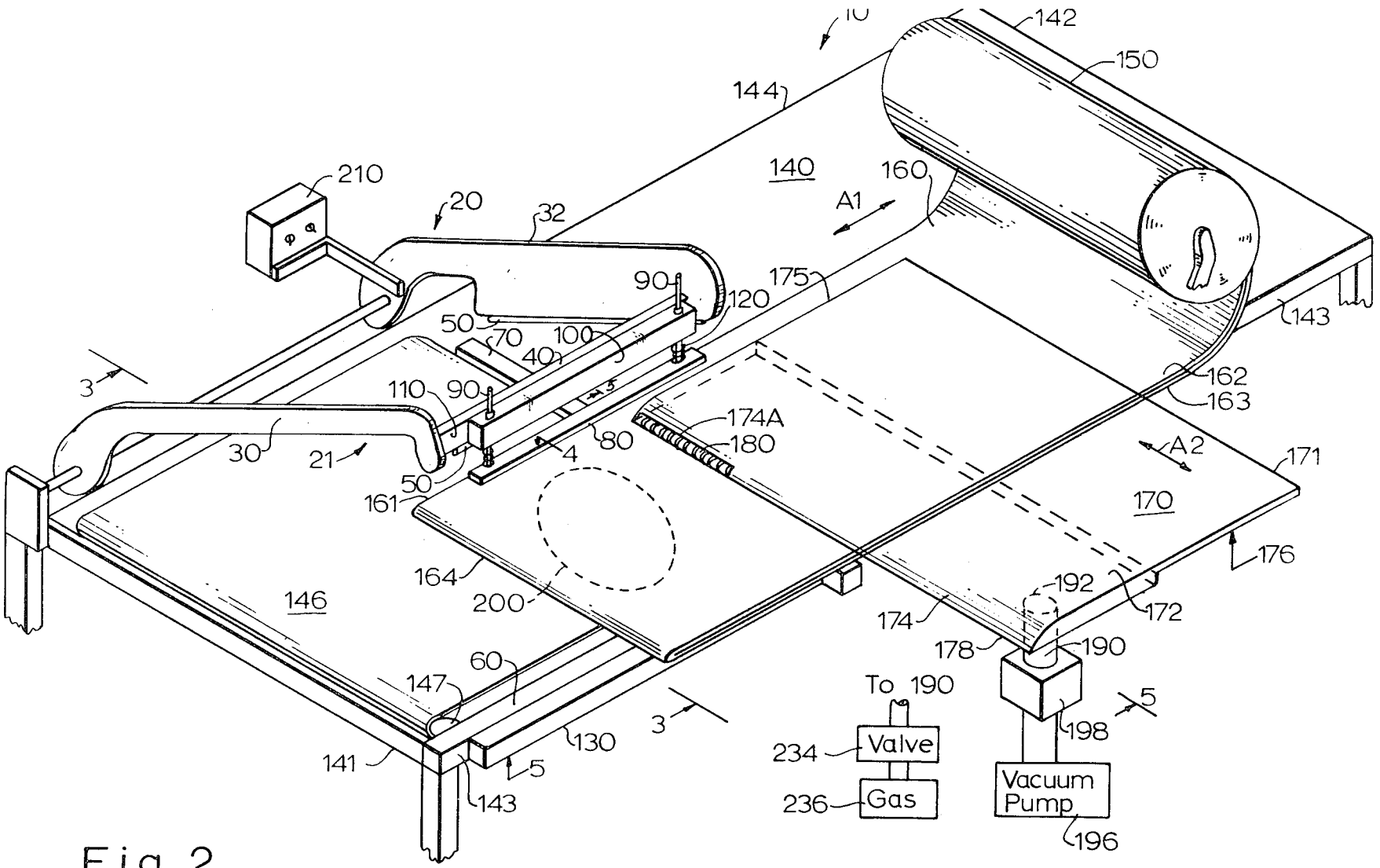
FIG. 2 is a perspective view of apparatus embodying the invention.

The principles of the present invention 10 are illustrated with a sealing apparatus 20 known as an L-sealer. The apparatus 10 includes a horizontal support table 140 having a front end 141, a rear end 142, a right side edge 143 and a left side edge 144. The table has a longitudinal axis A1, and, at its front end, it has a rectangular opening in which a horizontal conveyor 146 is disposed. The conveyor is mounted on transverse rollers 147 so that it moves along a path which is parallel to the longitudinal axis A1 of the table. The conveyor supports a product in its package, as it is being formed, in a manner to be described.

In the apparatus, L-sealer 20 is mounted in operative relation with the conveyor 146, and it includes a pivotable, generally rectangular sealing frame 21 having side bars 30 and 32 and a front bar 40. Side bars 30 and 32 are disposed transverse to the longitudinal axis of the table 140, and front bar 40 is parallel to the side 143 of table 140. The frame 21 is mounted so that it can pivot toward and away from table 140 by having the rear ends of side bars 30 and 32 pivotally mounted on shaft 145 which is suitably supported on the table adjacent to the side 144 of table 140 and parallel to the longitudinal axis A1 of the table 140. The sealing frame 21 carries an L-shaped heating wire 50 which is connected to a power supply and is suitably mounted along the lower surfaces of the side bar 32 and front bar 40, as is well known in the art. Heating current is passed through the heating wire 50 for heating, fusing, and sealing film material. The L-sealer 20 also includes a fixed lower front counter seal bar 60 and fixed side counter seal bar 70 which act as counter plates for the sealing bars 40 and 32, respectively, when a seal is formed. Counter seal bar 60 is disposed along the side edge 143 of table 140 and along the side of the conveyor, and counter side seal bar 70 is disposed across table 140 at the rear end of the conveyor 146.

According to the invention, a spring-loaded clamp mechanism is secured to the front seal bar 60, and a counter pressure bar, for operation therewith, is secured to the front surface of the front counter bar. Specifically, this mechanism includes an upper clamp bar 80 having two vertical posts 90 which are slidably mounted in a bar 100 which is secured to the front surface 110 of the front sealing bar 40. Springs 120 are disposed on the posts 90 between the upper clamp bar 80 and the bar 100 to bias the upper clamp bar 80 downwardly. The upper clamp bar 80 is aligned with a front, lower counter-pressure bar 130 which is secured to the front surface of front counter seal bar 60.

A supply roll 150 of folded film 160 is provided and suitably supported adjacent to the L-sealer 20 and table 140 and positioned to feed the film to the sealer on a path of travel which is parallel to the longitudinal axis A1 of the table 140. The film is folded along edge 161 to provide an upper web 162 and a lower web 163. The film comes off the roll with the edge 161 positioned between the long side edges of the table and facing edge 144 of table 140. The open side of the film lies adjacent to the side edge 143 of the table 140 and is disposed on the counter seal bar 60 and on counter-pressure bar 130 and beneath the front sealing bar 40 and clamp bar 80 of the sealing frame. The leading end 164 of the film 160 is sealed shut in a preliminary operation or as a result of the formation of a bag in a previous operation.

According to the invention, the apparatus 10 includes a generally rectangular loading tray 170 which is oriented horizontally and is disposed above the table 140, just rearwardly of the L-sealer 20. The spacing between the tray 170 and the table 140 is sufficient to permit the film 160 to be drawn between the tray and the table. The tray includes left side edge 175 and right side edge 176, a front edge 174 and a rear edge 171. The side edge 175 of the tray 170 is positioned generally in alignment with the edge 161 of the film whose supply roll 150 is disposed rearwardly of the tray 170. The tray has a longitudinal axis A2, and it lies across table 140, with the axes A1 and A2 generally perpendicular to each other. Thus, the tray lies across the table, and it extends laterally beyond the side 143 of the table by a suitable amount. The front end 174 of the tray 170 lies close to the front end of the conveyor and seal bar 70.

The loading tray 170 is disposed between the upper and lower webs 162 and 163, respectively, of the film with side edge 175 in the fold edge 161 of the film.

The loading tray 170 is provided with a vacuum chamber 172 which extends along the width of the front or leading portion adjacent to the conveyor 146 and the side counter seal bar 70. The vacuum chamber 172 is closed except for a series of apertures or openings 180 disposed along a portion 174A of its leading edge 174 and between the sides of the folded film when the film is in place, so that the openings 180 communicate with the interior of a bag formed by the film, as described below.

Figure 4:
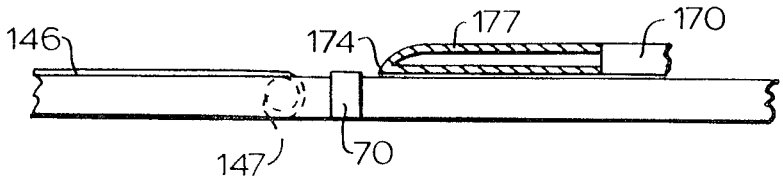
FIG. 4 is a side elevational view, partly in section, of a portion of the apparatus of FIG. 2.

In one arrangement, the open or apertured portion 174A of the front end 174 of the tray 170 extends from the side edge 175 of the tray a distance which is less than the width of the bag to be formed. The remainder of the front end has a cross-section, as shown in FIGS. 1 and 4, which shows that the front edge 174 is generally pointed and is formed by the top surface 177 being curved gradually toward the bottom surface 178 of the tray. This structural arrangement is for a purpose to be described.

Figure 5:
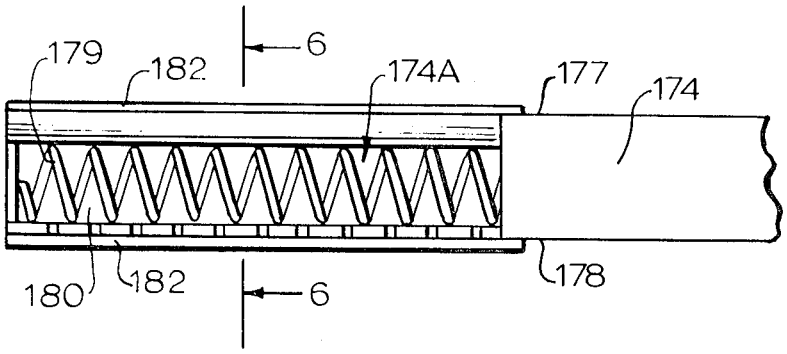
FIG. 5 is a view along the lines 5—5 in FIG. 2.
Figure 6:
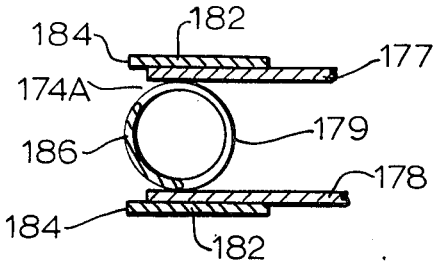
FIG. 6 is a sectional view along the lines 6—6 in FIG. 5.
Figure 7:
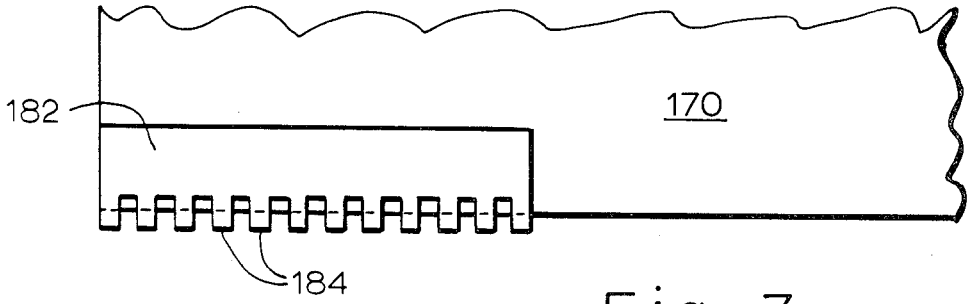
FIG. 7 is a plan view of the apparatus of FIG. 5.
Figure 8:
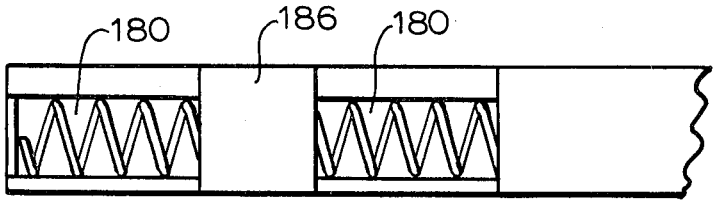
FIG. 8 is a front view of a modification of the apparatus shown in FIG. 5.
Figure 9:
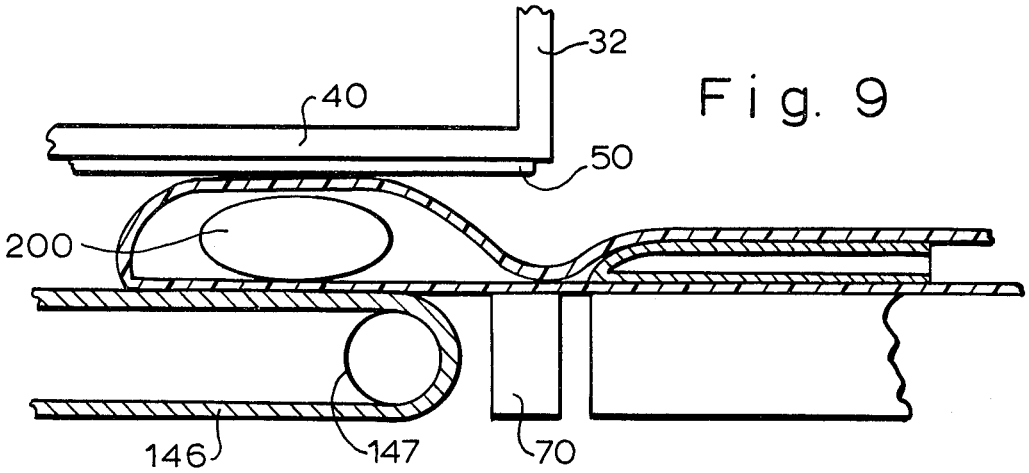
FIG. 9 is a side elevational view, partly in section, of a portion of the apparatus of FIG. 2 in one stage of its operation.
Figure 10:
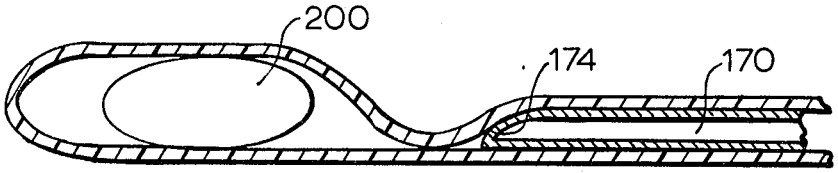
FIG. 10 shows a portion of the apparatus of FIG. 9 at another stage in its operation.

Referring to FIGS. 5 and 6, the apertures in the open portion 174A of the front end of the tray are formed, in one arrangement, by a cylindrical coil spring 179 disposed in the open portion 174A of the front end of the tray, the spring being suitably stretched to provide the desired openings or air passages 180 between the individual coils, through which air can flow. The spring 179 is stretched as required to provide optimum air flow. As seen in FIG. 6, the spring 179 is positioned so that the leading edge of the coils extends slightly beyond the front edges of the upper and lower walls of the tray.

According to the invention, in order to prevent the film 160 from adhering to the spring 179 and blocking the air passages 180, as suction is applied, flexible plates 182, of metal, plastic or the like, are secured to the upper and lower surfaces of the tray, along the length of the opening 174A in the front end. The flexible plates have serrated or comb-like front edges 184 which extend slightly forwardly of the coil spring 179.

In addition, under some circumstances and for packaging certain types of products, a strip of tape or the like 186 is secured to the central portion of the spring 179 to block this portion and provide two portions of evacuating orifices 180 at the two ends of the spring and at the ends of openings 174A. This assures better and faster air evacuation around the product.

An evacuation pipe 190 has one end 192 coupled to the interior of the vacuum chamber, and it is suitably connected to a vacuum pump 196 through a vacuum valve 198.

In operation of the invention, referring to FIGS. 1, 2, 3, 9, and 10, the film 160 with its leading end 164 closed is drawn toward the L-sealer 120, with the sealing tray 170 disposed between the upper web 162 and the lower web 163. The side edge 175 of the tray 170 is disposed generally at the fold 161 of the film. The product 200, to be packaged, is placed on the loading tray beneath the upper web of film, and, by hand or by some suitable means, it is moved up to the closed end 164 of the film, and it is pushed against the closed end of the film until it is suitably located on on the conveyor in sealing position with respect to the L-sealer 20.

After the product and film are advanced into the seal zone and appear as seen in FIG. 2, the seal frame 21 is partially closed by an amount sufficient to permit the clamp bar 80 to clamp the upper and lower webs together and to close off the open side of the film (FIG. 3). The product is now effectively located in a partial pouch of film which is closed on three sides, one side being the original folded edge 161 of the folded film, the second side being the sealed leading edge 164, and the third side is the formerly open side which is clamped shut by the clamp bars 80 and 130. Only the rear end of the pouch is open directly adjacent to and facing the openings 180 in the vacuum chamber 170. The openings 180 are actually inside the open end of the bag, and the film is still continuous back to the supply roll.

The vacuum valve 198 is now opened, and the vacuum chamber begins to evacuate the partial pouch containing the product 200. Due to the shape of the leading or front edge 174 of the tray, the film is drawn tight against the edge 174, and the evacuation of the bag is facilitated. When the desired level of evacuation has been achieved, the seal bar stroke is completed to bring the seal frame 20 down onto the bag, to pass current through wire 50, and to completely seal off and separate the now evacuated package from the main film supply along a line defined by side bar 32.

The apparatus is now ready for the next bag-filling and sealing operation which takes place as described above.

It is noted that satisfactory evacuation can be effected with or without the blocking of the central portion of the evacuation spring by tape 186. However, where a rather bulky product is packaged, the use of the blocking tape provides suction at the two ends of the evacuation region, and this draws air effectively from around the bulky product and speeds evacuation of the bag.

If desired, all operations can be performed automatically with pre-settable timers and controls represented schematically at 210 provided to set the time intervals required to achieve the desired level of evacuation and to give an audible or visual signal at the termination of this interval so as to notify the operator or other apparatus as to when to complete the seal bar stroke. Automatic product feed can also be provided.

If desired, a source 236 of gas, which is to be inserted in the bag after it has been evacuated and before it is sealed, may be provided coupled through a valve 234 to pipe 190 or by another pipe into the vacuum chamber.

It is clear that changes might be made in the specific apparatus described within the scope of the invention. For example, the evacuation orifices 180 may be formed by some other means than a stretched coil spring, and the principles of the invention might be employed with any suitable type of sealer other than an L-sealer.

What is claimed is:

1. Apparatus for forming a packaged product comprising a supply of bag-forming film, first means for forming an open-ended bag from said film, second means coupled to the open end of said bag for evacuating said bag, third means for sealing the open end of said bag, said second means comprising a chamber disposed across the open end of said bag and having a front end which faces the inside of said bag, said front end including an apertured portion and an adjacent unapertured portion, and fourth means blocking a portion of said apertured portion.

2. The apparatus defined in claim 1 and including means for severing said sealed bag from said supply of film.

3. The apparatus defined in claim 1 wherein said fourth means includes means blocking the central portion of said apertured portion to provide two spaced-apart apertured portions through which air can be evacuated from said bag.

4. The apparatus defined in claim 1 and including a pair of plates, one plate secured above and one plate secured below said apertured portion of said chamber and positioned to prevent said bag-forming film from adhering to said apertured portion and blocking the flow of air therethrough.

5. Apparatus for forming a packaged product comprising a supply of bag-forming film, first means for forming an open-ended bag from said film, second means coupled to the open end of said bag for evacuating said bag, and third means for sealing the open end of said bag, said bag including an upper and lower web and said second means comprises a chamber disposed across the open end of said bag, said chamber having a top surface and a lower surface and disposed between said upper and lower webs of said bag, said chamber having a front end facing the inside of said bag and including an apertured portion disposed within said bag and an unapertured portion disposed partly within said bag and extending laterally beyond a side edge of said bag, and a pair of plates secured to said top and lower surfaces of said chamber and extending forwardly beyond the front end of said chamber toward the inside of said bag for preventing said upper and lower webs from resting on and blocking said apertured portion of the front end of said chamber and thereby blocking the flow of air from inside the bag and into said chamber.

6. Apparatus for forming an evacuated packaged product comprising a support table having a longitudinal axis, sealing means adjacent to said support table, a supply of bag-forming film disposed adjacent to said sealing means and adapted to feed the film on a path along said longitudinal axis to said sealing means, said film including an upper web and a lower web which form a bag having an open end, and a tray disposed between said supply of film and said sealing means, said tray being adapted to support a product to be placed in a bag formed of said film, said tray being disposed between said upper and lower webs of said film as the film comes from said supply, said tray including an evacuation chamber for removing air from between said upper and lower webs of said film before said sealing means forms said film into an evacuated, closed bag.

7. The apparatus defined in claim 6 and including means for severing said closed bag from said supply of film.

8. The apparatus defined in claim 6 wherein said tray comprises a thin, flat chamber disposed across the open end of said bag and having an apertured front edge through which air is evacuated from said bag.

9. The apparatus defined in claim 6 wherein said tray comprises a thin, flat chamber disposed across the open end of said bag and having a front end which faces the inside of said bag, said front end including an apertured portion and an adjacent unapertured portion.

10. The apparatus defined in claim 9 and including means blocking a portion of said apertured portion.

11. The apparatus defined in claim 9 and including means blocking the central portion of said apertured portion to provide two spaced-apart apertured portions through which air can be evacuated from said bag.

* * * * *